US007022029B2

(12) United States Patent
Caldwell

(10) Patent No.: US 7,022,029 B2
(45) Date of Patent: Apr. 4, 2006

(54) GOLF CLUB HEAD WITH FILLED CAVITY

(75) Inventor: Bruce G. Caldwell, La Quinta, CA (US)

(73) Assignee: Ceramixgolf.com, Inc., Carlsbad, CA (US)

( * ) Notice: Subject to any disclaimer, the term of this patent is extended or adjusted under 35 U.S.C. 154(b) by 0 days.

(21) Appl. No.: 11/082,143

(22) Filed: Mar. 15, 2005

(65) Prior Publication Data

US 2005/0159246 A1 Jul. 21, 2005

Related U.S. Application Data

(63) Continuation of application No. 10/741,333, filed on Dec. 9, 2003, now Pat. No. 6,899,637, which is a continuation of application No. 10/219,624, filed on Aug. 15, 2002, now Pat. No. 6,729,971.

(51) Int. Cl.
*A63B 53/04* (2006.01)

(52) U.S. Cl. ..... 473/324; 473/345; 473/349; 473/409; 473/346; 273/DIG. 15

(58) Field of Classification Search ..... 473/324–350; 273/DIG. 15
See application file for complete search history.

(56) References Cited

U.S. PATENT DOCUMENTS

| | | | | | |
|---|---|---|---|---|---|
| 376,277 | A | * | 1/1888 | Barrett | 30/313 |
| 1,567,248 | A | * | 12/1925 | Dahlman | 473/342 |
| 1,975,341 | A | * | 10/1934 | Young | 473/340 |
| 2,023,131 | A | * | 12/1935 | Gibson | 473/318 |
| 3,692,306 | A | * | 9/1972 | Glover | 473/306 |
| 3,843,122 | A | * | 10/1974 | Florian | 473/329 |
| 4,432,549 | A | * | 2/1984 | Zebelean | 473/346 |
| 4,465,221 | A | * | 8/1984 | Schmidt | 228/125 |
| 4,553,755 | A | * | 11/1985 | Yamada | 473/338 |
| 4,614,627 | A | * | 9/1986 | Curtis et al. | 264/46.6 |
| 4,988,104 | A | * | 1/1991 | Shiotani et al. | 473/305 |
| 5,190,290 | A | * | 3/1993 | Take | 473/342 |
| 5,306,450 | A | * | 4/1994 | Okumoto et al. | 264/45.1 |
| 5,445,382 | A | * | 8/1995 | Pearce et al. | 473/342 |
| 5,447,310 | A | * | 9/1995 | Jernigan | 473/330 |
| 5,505,448 | A | * | 4/1996 | Park | 473/327 |
| 5,509,659 | A | * | 4/1996 | Igarashi | 473/345 |
| 5,649,873 | A | * | 7/1997 | Fuller | 473/332 |
| 5,692,972 | A | * | 12/1997 | Langslet | 473/332 |
| 5,807,188 | A | * | 9/1998 | Serrano et al. | 473/338 |
| 5,916,042 | A | * | 6/1999 | Reimers | 473/334 |
| 5,941,782 | A | * | 8/1999 | Cook | 473/346 |
| 6,042,486 | A | * | 3/2000 | Gallagher | 473/329 |
| 6,059,669 | A | * | 5/2000 | Pearce | 473/339 |
| 6,149,534 | A | * | 11/2000 | Peters et al. | 473/345 |

FOREIGN PATENT DOCUMENTS

| | | | |
|---|---|---|---|
| GB | 376277 | * | 6/1932 |
| WO | PCT/AU00/00961 | * | 2/2001 |

* cited by examiner

*Primary Examiner*—Sebastiano Passaniti
(74) *Attorney, Agent, or Firm*—Gordon & Rees LLP

(57) ABSTRACT

A golf club head has a hollow body with a front, striking face, a rear face, an upper face, a heel and a toe, and an open lower end, the body having an internal cavity. At least one filler member of solid cork or synthetic cork material cut to match the shape and dimensions of at least part of the cavity is positioned in the cavity, and a sole plate is secured over the open lower end of the body.

5 Claims, 2 Drawing Sheets

GOLF CLUB HEAD WITH FILLED CAVITY

CROSS REFERENCE TO RELATED APPLICATIONS

This application is a continuation of application Ser. No. 10/741,333 filed Dec. 19, 2003, now U.S. Pat. No. 6,899,637, which was a continuation of application Ser. No. 10/219,624 filed Aug. 15, 2002, which issued on May 4, 2004 as U.S. Pat. No. 6,729,971.

BACKGROUND OF THE INVENTION

The present invention relates generally to golf clubs, and is particularly concerned with a golf club head having an internal cavity which is partially or completely filled.

It is known to provide various filler materials in the cavities of golf club heads for weighting and vibration damping purposes. In U.S. Pat. No. 4,438,931 of Motomiya, the head is filled with an elastic filler material such as foamed urethane and rubber. In U.S. Pat. No. 5,649,873 of Fuller, for example, a layer of cork particles and bonding material is adhered to the inner surface of the club head cavity. However, glued cork particles are relatively heavy and not particularly durable, given the wear and tear that occurs as a result of being compressed and de-compressed with repeated impacts of the head with a ball.

SUMMARY OF THE INVENTION

It is an object of the present invention to provide a new and improved golf club head with a filled cavity.

According to one aspect of the present invention, a golf club head is provided which comprises a hollow body having a front, striking face, a rear face, an upper face, a heel and a toe, and an open lower end, and a sole plate extending over the lower end of the body, the body having an internal cavity of predetermined shape and dimensions, and at least one piece of solid cork or synthetic cork material cut to match the shape and dimensions of at least part of the cavity, the solid cork piece being positioned in said cavity.

In an exemplary embodiment of the invention, two pieces of solid cork material are cut to match the shape and dimensions of different parts of the cavity, and, when positioned in the cavity, substantially fill the entire cavity. In another embodiment, one or more solid cork pieces partially fill the cavity, and the remainder of the cavity is filled with a foam filler material. In the latter case, the solid cork pieces fill at least 50% of the total internal volume of the cavity.

The solid cork or synthetic cork material filling or partially filling the cavity will give a better feel and more consistent transfer of energy than a golf club head filled with other materials, such as foam filler material or glued cork particles. It will also be more durable than glued cork particles on repeated use of the club head.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
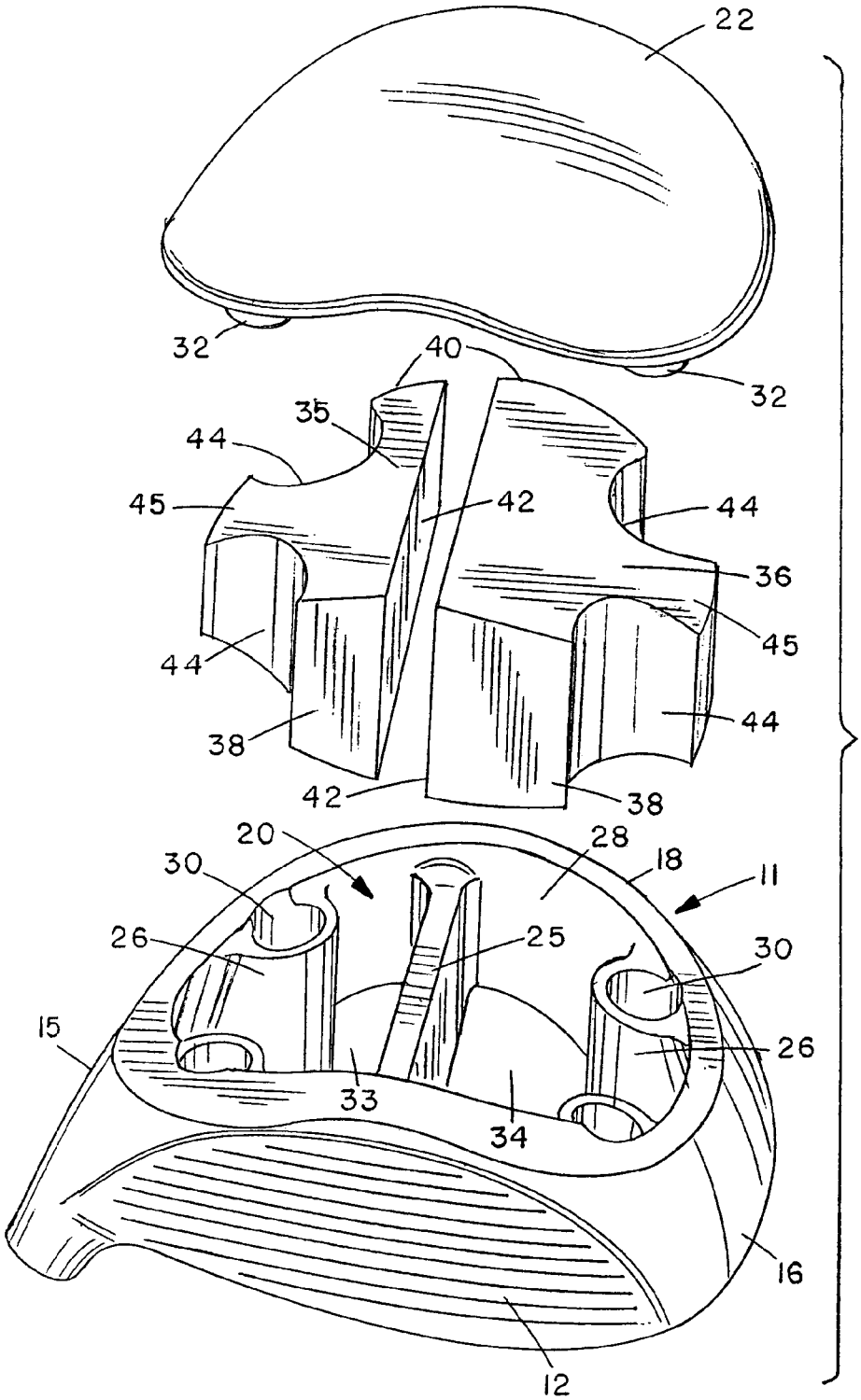
FIG. 1 is a perspective view of the separated components of the golf club head according to an exemplary embodiment of the invention.
Figure 2:
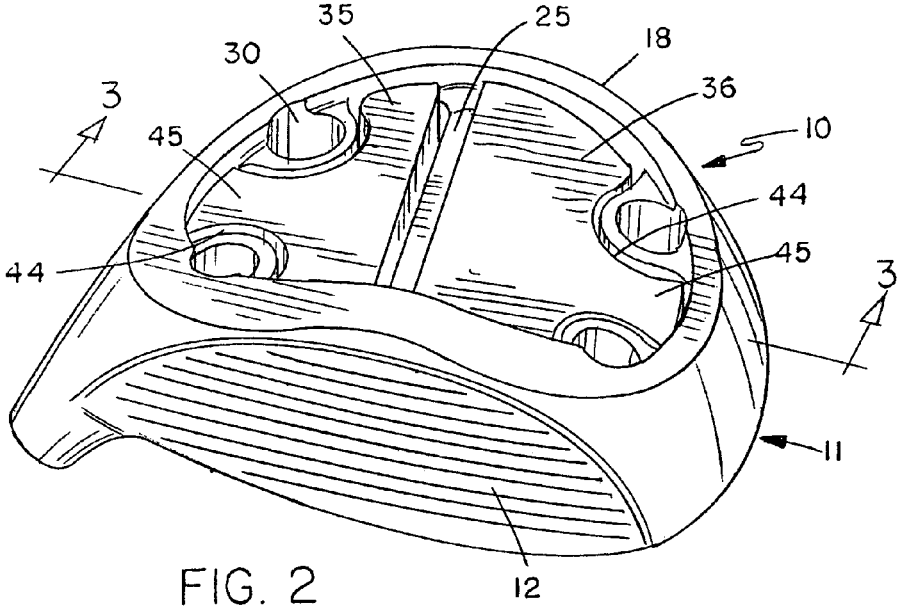
FIG. 2 is a perspective view of the head with the inserts in place.
Figure 3:
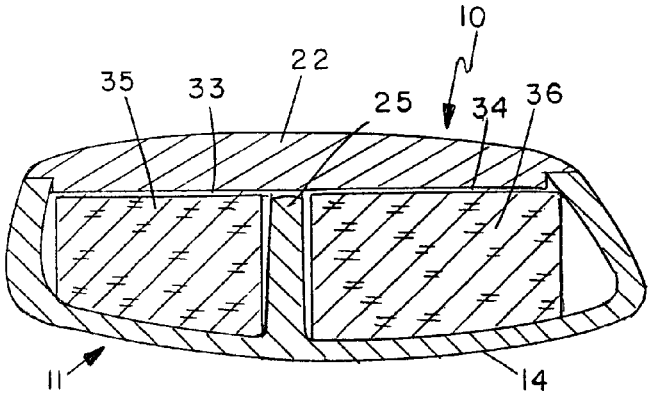
FIG. 3 is a sectional view taken on line 3—3 of FIG. 2.

FIGS. 1 to 3 of the drawings illustrate a golf club head 10 with a cork filled cavity according to one exemplary embodiment of the invention. The head 10 is of a conventional overall shape corresponding to a wood, but it will be understood that other types of golf club heads, including putters, irons, fairway clubs, and drivers, may also have cavities filled in an equivalent manner.

The club head 10 has a body or shell 11 having a front, striking face or wall 12, an upper wall or crown 14, a heel 15, a toe 16, a rear wall 18, and an open lower end 20. A separate sole plate 22 is secured over the open lower end of the body. The body has an internal cavity 24, and the body and sole plate may be made of any suitable rigid material such as metal, ceramics, composite material or the like. The cavity has a central rib or dividing wall 25 for added strength, and four spaced, hollow cylindrical posts 26 are formed at spaced intervals around the inner peripheral wall 28 of the cavity. The posts have bores 30 for receiving corresponding posts or pins 32 projecting from the inner face of sole plate 22 when the parts are secured together. However, the sole plate may alternatively be secured to the body by other mechanisms, such as screw fasteners, welding, and the like, in which case posts 26 will be eliminated. Additionally, the dividing wall 25 may also be eliminated in alternative embodiments.

Two chambers 33,34 are formed on opposite sides of the dividing wall 25. A pair of die cut pieces or insert members 35,36 of solid cork or synthetic cork material are designed for fitting into the respective chambers 33,34, as indicated in FIGS. 2 and 3, so as to substantially fill the cavity in the club head body. As indicated in FIG. 1, each solid cork member 35,36 has a generally flat front wall 38 for fitting behind the striking face 12, an arcuate or curved rear wall 40 for fitting against the inner face of the rear wall 18, an inner flat face 42 for placing against the dividing wall 25, and a pair of outer, arcuate cut-outs 44 for fitting around or over the respective posts 26, with a projection 45 extending between the posts 26, as best illustrated in FIG. 2. The members 35,36 are designed to be a force or press fit into the respective chambers, and may be secured in the cavity by an elastomer or the like. After insertion of the solid cork members, the sole plate 22 is secured in place.

Solid cork has advantageous properties when used as a single element filler member for part or all of a golf club head cavity. First, it is relatively light weight so that it does not add too much weight to the head even when the cavity is completely filled. It will tend to compress and reduce vibration when the ball is hit, and then de-compress or spring to provide better and more consistent transfer of energy to the ball. The weight of the solid cork product chosen to make the insert members can be selected to vary the overall club head weight, accommodating differences in player skill levels. The solid cork will be more durable on repeated use of the club head, unlike adhesively bonded cork particles which are more likely to deteriorate with extended use.

Although the cavity of the golf club head in the illustrated embodiment has a dividing wall 25 in the illustrated embodiment, the dividing wall may be eliminated in alternative embodiments. In that case, a single, continuous cavity will be formed and the two separate solid cork elements may be replaced with a single solid cork element of equivalent external shape to the two elements of FIG. 1 if secured together along inner faces 42. In either case, the die cut, solid piece or pieces of cork substantially fill the entire club head cavity to provide vibration damping, improved feel, and enhanced performance and energy transfer.

Figure 4:
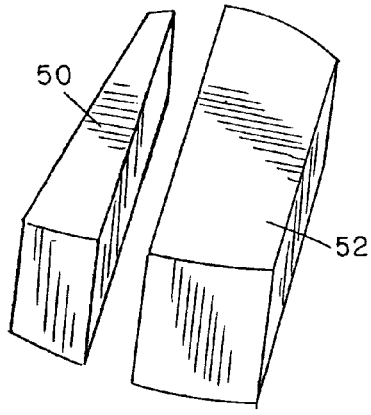
FIG. 4 is a perspective view of alternative inserts.
Figure 5:
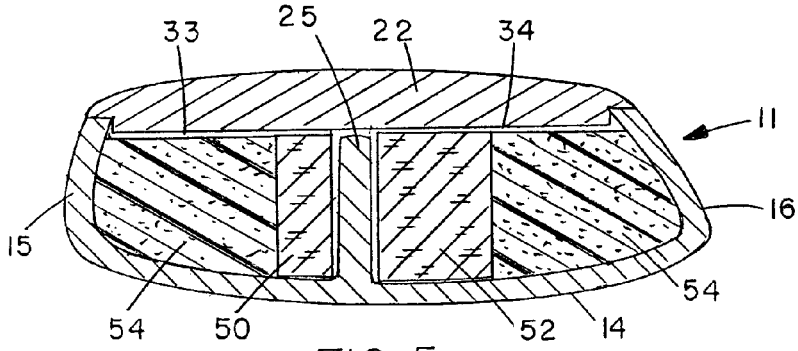
FIG. 5 is a sectional view similar to FIG. 3, but with the alternative inserts and foam filler material.

FIGS. 4 and 5 illustrate an alternative embodiment in which one or more solid pieces or members of die cut solid cork material partially fill the cavity of a golf club head. The golf club head, apart from the filler material, is otherwise the same as the previous embodiment, and like reference numerals have been used for like parts as appropriate. FIG. 4 illustrates two die cut members 50,52 of solid cork material which are designed to partially fill the respective chambers 33,34 on opposite sides of dividing wall 25. These members do not have any projections for extending between posts 26 up to the heel and toe of the head, respectively. Instead, each member is of predetermined width for filling the gap between the dividing wall 25 and innermost edge of the posts 26. The remainder of the cavity is filled with a conventional foam filler material 54. In this case, the solid cork members are positioned behind the central portion of the striking face 12, where the ball is normally struck, to provide optimum vibration damping and energy transfer. If the dividing wall is eliminated, the two separate members 50, 52 may be replaced with a single solid cork member to span the gap filled in FIG. 5 by the members 50,52 and wall 25.

The cork insert members will be cut to the exact size desired and then press fit into the cavity. An elastomer may be used to secure the cork in the cavity. Foam may be added around the outer edges if required to completely fill the cavity. The insert members may be of natural cork or any kind of synthetic cork substitute, such as extruded polymers or polymer pellets which are mixed, melted, and injection molded.

It will be understood that one or more members of solid cork material may be suitably cut to a predetermined shape and dimensions for partially or completely filling a cavity in any golf club head, not only the particular shaped internal cavities of the club head illustrated in FIGS. 1 to 5. The solid cork or synthetic cork member or members in the exemplary embodiment fill between 50% to 100% of the entire cavity, with the remainder of the cavity being filled with a foam filler material for percentages less than 100%. When the ball is struck, the cork member or members will be compressed to absorb shock and reduce vibration, and will then decompress in order to provide consistent transfer of energy. Solid cork is a more durable, lightweight material than some of the filler materials previously used in club heads. The properties of solid cork materials permit the quantity used and the weight of the cork to be varied, allowing overall club head weight to be adjusted.

Although some exemplary embodiments of the invention have been described above by way of example only, it will be understood by those skilled in the field that modifications may be made to the disclosed embodiments without departing from the scope of the invention, which is defined by the appended claims.

I claim:

1. A golf club head, comprising:

a hollow body having a front, striking face, a rear face, an upper face, a heel and a toe, and an open lower end, the body having an internal cavity of predetermined shape and dimensions;

at least one filler member consisting of one pre-formed piece of solid, natural cork of predetermined shape and dimensions substantially matching the shape and dimensions of at least part of the cavity, the filler member being press-fit into the cavity through the open lower end of the cavity;

the filler member or members being positioned in said cavity so as to substantially completely fill the cavity with no other filler material in the cavity; and a sole plate secured over the open lower end of the body.

2. The head as claimed in claim 1, wherein the filler member comprises a single filler member which substantially completely fills the cavity.

3. The head as claimed in claim 1, wherein there are at least two separate filler members each comprising one piece of solid, natural cork material in the cavity, the filler members together substantially completely filling the cavity.

4. A method of assembling a golf club head, comprising the steps of:

taking a hollow body having a front, striking face, a rear face, an upper face, a heel, and a toe, and an open lower end, the body having an internal cavity of predetermined shape and dimensions;

cutting a filler member from a piece of solid, natural cork material into a predetermined shape and dimensions substantially matching the shape and dimensions of the cavity, the filler member having a front face;

press-fitting the filler member into the cavity through the open lower end of the body and positioning the filler member in the cavity such that the filler member substantially completely fills the cavity with no other material in the cavity and the front face of the filler member fits closely against the inner surface of the front, striking face of the body; and securing the sole plate over the open lower end of the body.

5. A golf club head, comprising:

a hollow body having a front wall having an outer striking face and an inner face, a rear face, an upper face, a heel and a toe, and an open lower end, the body having an internal cavity of predetermined shape and dimensions;

a filler member consisting of one pre-formed piece of solid, natural cork of predetermined shape and dimensions matching the shape and dimensions of the cavity, the filler member being press-fit into the cavity through the open lower end of the cavity;

the filler member having a front face which fits closely against the inner face of the front wall of the body;

the filler member being positioned in said cavity so as to substantially completely fill the cavity with no other filler material in the cavity; and a sole plate secured over the open lower end of the body.

* * * * *